US006105227A

United States Patent [19]

Bota

[11] Patent Number: 6,105,227

[45] Date of Patent: Aug. 22, 2000

[54] APPARATUS AND METHODS FOR MANUFACTURING DUCTS

[76] Inventor: Victor Bota, 4185 Dawncliff Dr., Brooklyn, Ohio 44144

[21] Appl. No.: 09/008,738

[22] Filed: Jan. 19, 1998

[51] Int. Cl.[7] ..... B23P 11/00; B21D 39/00

[52] U.S. Cl. ..... 29/33 K; 29/564.7; 72/71; 72/307

[58] Field of Search ..... 29/33 K, 564.7, 29/33 D, 33 T; 72/52, 55, 58, 61, 62, 306, 307, 339, 71

[56] References Cited

U.S. PATENT DOCUMENTS

| | | | |
|---|---|---|---|
| 3,815,394 | 6/1974 | Walker | 72/58 X |
| 3,861,184 | 1/1975 | Knudson . | |
| 4,198,842 | 4/1980 | Pawlaczyk . | |
| 4,210,090 | 7/1980 | Stubbings | 72/52 X |
| 4,418,943 | 12/1983 | Ionna . | |
| 4,466,641 | 8/1984 | Heilman et al. . | |
| 4,881,762 | 11/1989 | Arnoldt . | |
| 5,069,484 | 12/1991 | McElroy . | |
| 5,090,101 | 2/1992 | Welty . | |
| 5,102,253 | 4/1992 | Conti . | |
| 5,105,640 | 4/1992 | Moore . | |
| 5,189,784 | 3/1993 | Welty . | |
| 5,243,750 | 9/1993 | Welty . | |
| 5,436,423 | 7/1995 | Welty . | |
| 5,450,879 | 9/1995 | Toben . | |
| 5,685,345 | 11/1997 | Gieseke et al. . | |

OTHER PUBLICATIONS

Iowa Precision, "AEM Gearhead Machines," General Operations Manual, 1st ed., (Jun. 9, 1994).

*Primary Examiner*—William Briggs
*Attorney, Agent, or Firm*—Oldham & Oldham Co.

[57] ABSTRACT

The invention provides a machine and methods for automated manufacture of tapered adjustable ducts, and particularly tapered adjustable take offs. A tube of material is cut into gores of predetermined configuration, coupling beads are formed in the gores and the gores are adjustably interconnected to one another to form the finished take off duct in an automated fashion. The apparatus for forming an adjustable duct member may include a housing including at least one work station formed therein. A die associated with the work station is selectively positioned at a predetermined location relative to a work piece positioned in association with the work station. A cutting and forming assembly associated with the work station cooperates with the die to selectively cut the work piece to form first and second members and to form a coupling bead in the first and second members which cooperate to reconnect the first and second members together at a predetermined angle. A positioning system positions the work piece at a predetermined position for cutting and forming the coupling beads in at least two predetermined locations in the work piece, and a control system is provided for at least selective control of the cutting and forming assembly associated with the work station, or of other characteristics of the apparatus as desired. A method of manufacturing an adjustable duct member may include the steps of providing a tube of material having a tapered configuration and predetermined dimensional characteristics for forming the duct member. The tube is positioned in a work station at a first predetermined position relative to a cutting and forming assembly of the work station. The tube is then cut at a first predetermined position to form first and second members, and these members are then positioned in overlapping relationship to one another. A bead is formed in the first and second members at a position to cooperate with one another to allow relative rotation of the first and second members and to interlock these members. The tube is then repositioned in a work station at a second predetermined position relative to a cutting and forming assembly. The tube is cut at a second predetermined position to form first and second members, and these members are positioned in overlapping relationship to one another. A bead is formed in the first and second members at a predetermined position to cooperate with one another to allow relative rotation of the first and second members and interlock these members.

17 Claims, 4 Drawing Sheets

FIG.-1
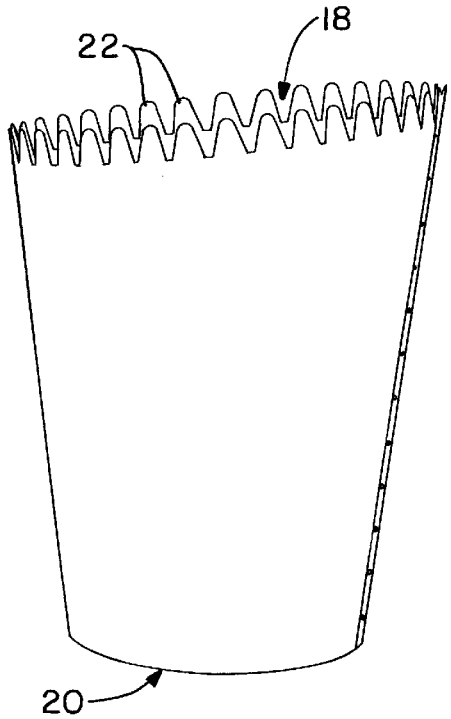
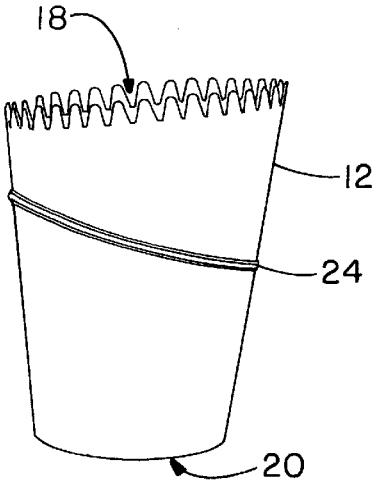
FIG.-2
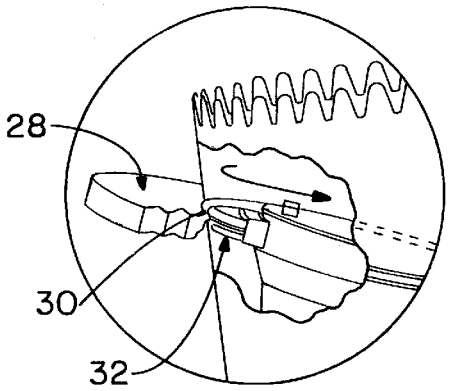
FIG.-3
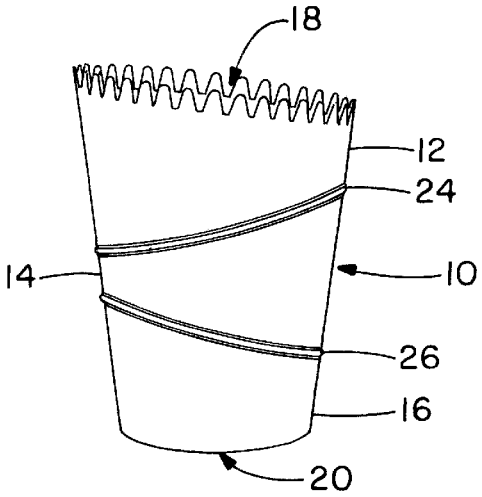
FIG.-4
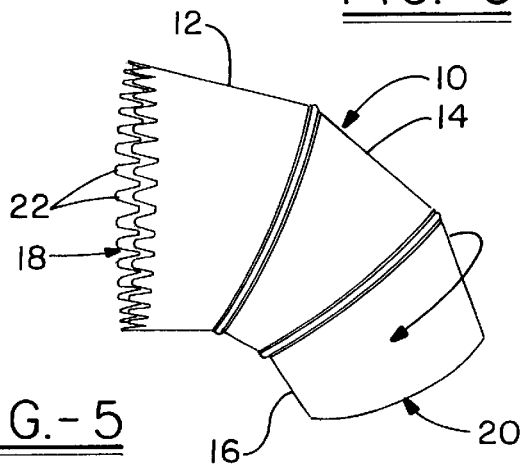
FIG.-5

APPARATUS AND METHODS FOR MANUFACTURING DUCTS

BACKGROUND OF THE INVENTION

The invention is generally directed to an apparatus and methods for producing duct work, and particularly for the manufacture of a top take off duct for use in an air handling system.

In general, duct work is commonly used in heat and air-conditioning systems for buildings and the like, with the duct work providing a distribution system to various areas of the building from a furnace and/or air-conditioning system. Coupling a round duct to the furnace or main trunk line is commonly provided via a top take off duct member which is positioned in association with the air handling equipment, and provides the outlet for forced air to exit the trunk line or extended plenum for distribution to the registers. Typically, such a top take off comprises a cylindrical fitting associated with a length of cylindrical tubing which is coupled to an outlet opening in a high pressure plenum of the air handling system. The fitting is installed into and fixed in position with respect to the outlet opening in the wall of a trunk line or plenum. This take off duct can then be coupled into cylindrical duct work which extends to various portions of the building or the like. Depending on the particulars of an installation of an air handling system, it is many times problematic to efficiently couple into the top take off, as the position of the duct work may not correspond to the location of the top take off. Various fittings and interconnections are then necessary to couple the duct work to the air handling system, being a labor intensive and time-consuming process.

Attempts to simplify connection of round duct work to a trunk line or plenum have included forming the top take off as an adjustable elbow which allows the orientation and position of the take off to be readily adjusted to simplify positioning and interconnection to the duct system. Such adjustable elbows typically will include three sections, each section being rotatable relative to the others. Each section in the take off is formed so as to be connected at an angular orientation relative to an adjacent section, whereupon relative rotation will vary the orientation of the outlet portion of the take off to simplify coupling into further duct work. Known adjustable take offs may be produced in different ways, but typically utilize a machine which a skilled operator uses for cutting and forming of each of the sections in the take off. Each of the sections may be adjustably coupled to an adjacent section by means of a bead coupling wherein a portion of each section is flared outwardly to engage a similar bead in an adjacent section, thereby locking the pieces together but allowing relative rotation therebetween. Known machines for producing and locking these sections together to form an adjustable take off are problematic, in that many of the stages of production of the sections in the take off are performed manually in the with a machine for cutting and beading of the take off sections. A skilled operator is therefore necessary to properly form each section and couple the sections together in a manner that they can be adjusted to one another. The difficulty of properly forming each section and connecting the sections together result in a high percentage of scrap as well as take offs which do not function well. More recently, automated take off machines have been produced which are designed to form straight take offs, wherein a cylindrical tube is cut into multiple pieces with the pieces being reassembled and locked together in an adjustable coupling. Although such apparatus is capable of forming a more uniform adjustable coupling between sections of the take off in a repeatable fashion, only straight take offs are able to be manufactured, with each section of the take off having a common diameter.

To improve the efficiency with which the air handling system distributes warm and/or cool air to various areas of the building, it is preferable to increase the velocity of the air as it leaves the plenum of the air handling system and enters the duct work extending to various portions of the building. By tapering the take off duct as it extends from the plenum, the velocity of air introduced into the duct work is significantly increased as desired. For example, a tapered take off may have an initial opening of seven inches for connection to the plenum, while the outlet opening thereof may be reduced to six inches or less. This tapered configuration increases the velocity of the air as it leaves the take off in an effective and inexpensive manner. Of particular advantage is tapering the take off continuously from the inlet to the outlet, or having each gore of the duct tapered. Presently, no apparatus or methods exist for automated manufacture of tapered adjustable ducts, such as for use as a top take off of an air handling system.

SUMMARY OF THE INVENTION

Based upon the foregoing, there is a need for an apparatus and methods for automated manufacture of tapered adjustable ducts, and particularly tapered adjustable take offs. It is therefore a primary objective of this invention to provide an apparatus and methods for manufacturing an adjustable duct member, particularly a tapered duct member, wherein portions of the adjustable duct member are rotatably interlocked with one another to vary the orientation of the outlet side of the duct member. More particularly, there is a need for an apparatus and methods which allow the manufacture of a tapered take off duct, wherein a tube of material is cut into gores of predetermined configuration, coupling beads are formed in the gores and the gores are adjustably interconnected to one another to form the finished take off duct in an automated fashion.

Accordingly, the invention provides an apparatus for forming an adjustable tapered top take off duct member for use in an air handling system. The apparatus may comprise a housing including at least one work station formed therein. A die associated with the work station is selectively positioned at a predetermined location relative to a work piece positioned in association with the work station. A cutting and forming assembly associated with the work station cooperates with the die to selectively cut the work piece to form first and second members and to form a coupling bead in the first and second members which cooperate to reconnect the first and second members together at a predetermined angle. A positioning system positions the work piece at a predetermined position for cutting and forming the coupling beads in at least two predetermined locations in the work piece, and a control system is provided for at least selective control of the cutting and forming assembly associated with the work station, or of other characteristics of the apparatus as desired. In one embodiment, the apparatus includes an upper surface positioned at a predetermined angle. The upper surface has at least two work stations or nests formed therein, with each of the nests formed as a recess in the upper surface and including a base for positioning of a work piece at a predetermined position with respect to the upper surface. A die associated with each of the nests is supported on the upper surface. A cutting and forming system associated with each nest cooperates with the die to selectively cut a work piece positioned in the nest into members, and to form a coupling bead in the members to reconnect the members together at the predetermined angle.

The invention also provides a method of manufacturing an adjustable duct member comprising the steps of providing a tube of material having a tapered configuration and predetermined dimensional characteristics for forming the duct member. The tube is positioned in a work station at a first predetermined position relative to a cutting and forming assembly of the work station. The tube is then cut at a first predetermined position to form first and second members, and these members are then positioned in overlapping relationship to one another. A bead is formed in the first and second members at a position to cooperate with one another to allow relative rotation of the first and second members and to interlock these members. The tube is then repositioned in a work station at a second predetermined position relative to a cutting and forming assembly. The tube is cut at a second predetermined position to form first and second members, and these members are positioned in overlapping relationship to one another. A bead is formed in the first and second members at a predetermined position to cooperate with one another to allow relative rotation of the first and second members and interlock these members.

Other objectives and advantages of the invention will become apparent from the following detailed description of a preferred embodiment taken in conjunction with the drawings.

BRIEF DESCRIPTION OF THE DRAWINGS

FIG. 1 is a plan view of a tube which is manufactured into an adjustable duct according to the invention.

FIG. 2 is a plan view of the tube as shown in FIG. 1, with a first adjustable bead formed therein between two gores of the tube.

FIG. 3 shows an enlarged partial cutaway view of the tube as shown in FIG. 2, showing a die and associated cutting and forming system for producing the two gores in the tube and forming the adjustable bead therebetween.

FIG. 4 is a plan view of the tube as shown in FIG. 2, and further showing a second adjustable bead formed between gores of the tube.

FIG. 5 is a plan view of the duct member, showing adjustability of each gore of the duct member relative to one another.

DETAILED DESCRIPTION OF THE INVENTION

Figure 7:
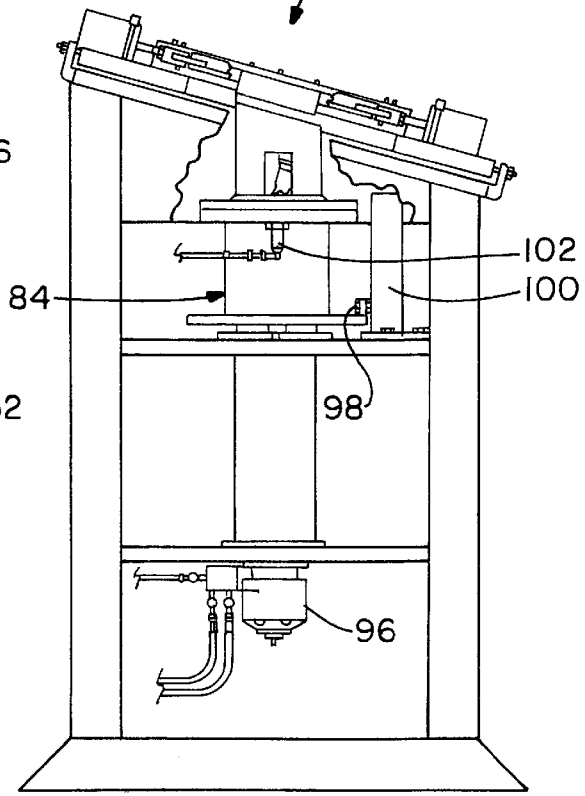
FIG. 7 is a side view of the apparatus as shown in FIG. 6.

Turning now to FIGS. 1–5, the invention is directed at producing an adjustable duct member such as shown in FIGS. 4 and 5, wherein the duct member 10 may include three sections or gores 12, 14, and 16. The duct member 10 further includes an inlet opening 18 and an outlet opening 20, being adapted to be coupled between other members in a duct system, or preferably as a top takeoff connected into a plenum associated with the air handling system. To facilitate connection of the duct member 10 in association with a plenum, inlet opening 18 may be provided with a plurality of tabs 22 which may be selectively bent into engagement with an inner wall of the plenum through an opening formed therein. The duct member 10 further preferably includes a taper from the inlet opening 18 to the outlet opening 20, such that each of the gores 12, 14 and 16 become progressively smaller. The tapering of the gores 12, 14 and 16 provide a significant increase in velocity of air passing through duct 10 from the plenum of the air handling system. The duct member 10 may be produced from a flat blank of material which is rolled such that opposed seams of the blank slightly overlap and are coupled to one another to form the tubular configuration. Coupling at the overlapping seams may be provided in any suitable manner, such as by riveting or the like. As an example, the tubular configuration of the formed blank of material may provide a starting work piece as shown in FIG. 1, which may then be operated on by the apparatus and methods of the invention. The work piece as shown in FIG. 1 is designed to have a predetermined configuration and dimensional characteristics for use in the apparatus and methods of the invention, but any suitable particular dimensional characteristics of the work piece can be accommodated. As an example, the tapered tube as shown in FIG. 1 may have an inlet opening 18 having a diameter of seven inches, while the outlet opening 20 has a diameter of 5.7 inches.

The apparatus and methods of the invention will take the work piece as shown in FIG. 1 and produce adjustable seams or beads 24 and 26 in the work piece to form the duct member 10 in the final preferred form as shown in FIGS. 4 and 5. To produce this configuration, a first adjustable seam 24 is produced at a predetermined position and orientation relative to the inlet and outlet openings 18 and 20. It is noted that in the desired configuration of the work piece as shown in FIG. 1, the inlet opening 18 is angled relative to the outlet opening 20, such that when the duct member 10 is installed in association with a plenum, the first gore 12 will be angled at 30° relative to the wall of the plenum. The first adjustable seam 24 produced in duct member 10 is thereafter preferably oriented at an angle of 15° relative to the plane of the outlet opening 20, and oriented in opposing relationship to the orientation of outlet opening 18. The second adjustable coupling bead 26 is thereafter preferably formed again at an angle of 15° relative to the plane of outlet opening 20 and in opposing relationship to adjustable coupling bead 24 as shown in FIG. 4. With this preferred configuration, the duct member 10 may be configured such that inlet and outlet openings 18 and 20 are coaxial as shown in FIG. 4, or by adjustment of gores 12, 14 and 16 relative to one another, at 90° to one another. The adjustment of gores 12, 14 and 16 relative to one another is shown in FIG. 5.

The coupling beads 24 and 26 formed in the duct member 10 are preferably formed by means of a cutting and forming system in conjunction with a die positioned about the member 10. As shown in FIG. 3, the apparatus of the invention includes a die, generally shown at 28 having a shaping section 30 formed on a portion of the die 28 adjacent the exterior surface of member 10. On the interior of the tube 10, a cutting and forming system generally designated 32 is provided to selectively cut and shape portions of the tube in cooperation with die 28 to form the coupling beads 24 and 26. The operation of the apparatus will be discussed in more detail as the description proceeds.

Figure 6:
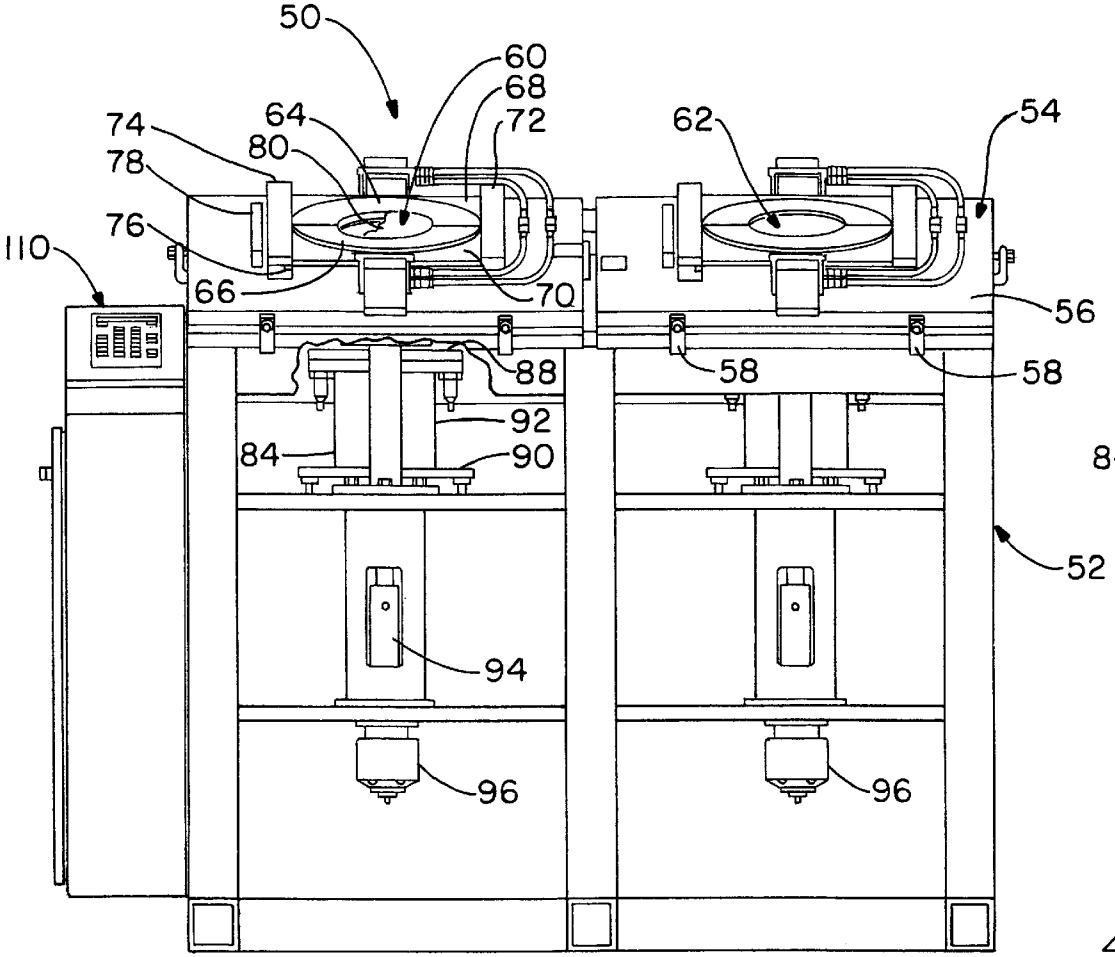
FIG. 6 shows a plan view of an apparatus for forming an adjustable duct member according to the invention.
Figure 8:
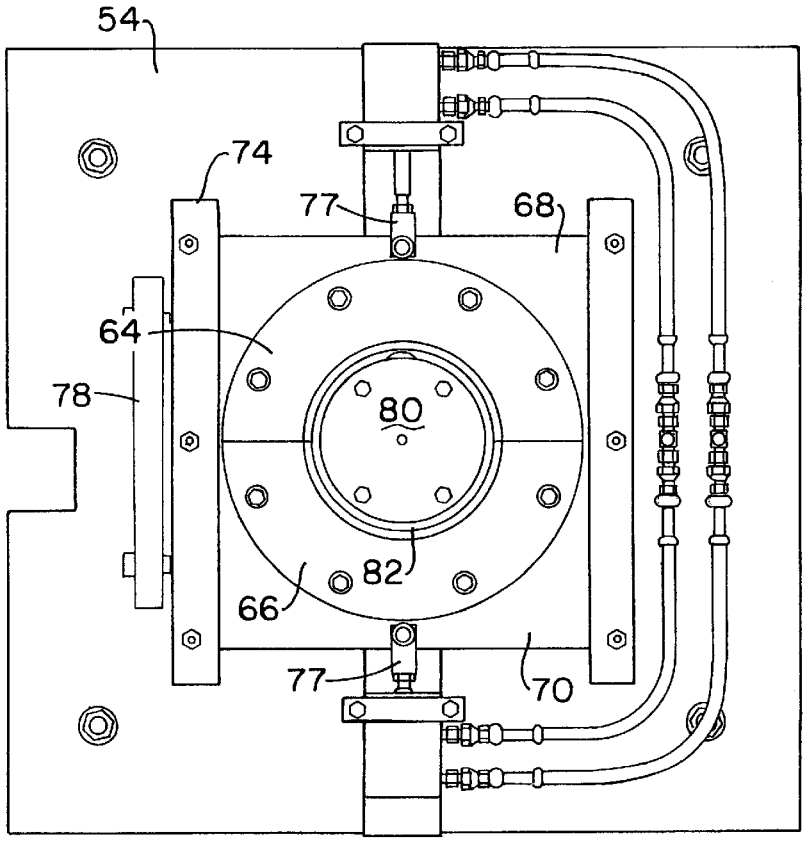
FIG. 8 is a top view of the apparatus as shown in FIG. 6.

Turning now to FIGS. 6–8, a preferred embodiment of the apparatus according to the invention is shown in more detail.

The apparatus generally designated 50 includes a housing or frame construction 52 which supports various components of the apparatus. Housing or frame 52 includes an upper surface 54 which is preferably defined by a floating support plate 56 which is adjustably mounted to the frame 52. The upper support plate 56 is angled at a predetermined angle relative to horizontal or ultimately to the plane of the outlet opening 18 associated with the work piece (described previously in FIGS. 1–5), which is supported on a base plate provided as a part of an operating nest arrangement to be more fully described hereafter. Providing plate 56 with some adjustability allows an operator to adjust this predetermined angle to produce a predetermined component as desired. The plate 56 may be held in position by a plurality of support fasteners 58 or other suitable devices. The upper surface 54 of the apparatus 50 includes at least two work stations or nests generally designated 60 and 62, each of which is formed as a recess adapted to accept the work piece discussed in previous figures to perform the operations for cutting and forming the coupling beads between gores of the work piece as described. Alternatively, the apparatus of the invention could utilize only one work station in which multiple cutting and coupling bead forming steps could be performed to fabricate the desired adjustable duct member. The work station would provide the cutting and coupling bead forming steps in at least two predetermined locations, and with the tapered tube, would accommodate different diameters of the tube to perform these steps.

In the particular embodiment shown, each of the nests and associated components to perform those operations are substantially identical in many respects, except that the work piece is positioned differently in each nest 60 or 62 to form one or the other of the cutting and forming operations to produce the adjustable duct member of the invention. As shown in the figures, each nest 60 or 62 can include a die supported on the upper surface, which in the preferred embodiment may be comprised of first and second semicircular members 64 and 66 which are positioned on opposed sides of the nests 60 or 62. The die members 64 and 66 are positioned immediately adjacent the nest 60 or 62 in operation, but preferably may be moved into a nonoperational position away from the nest 60 or 62 when desired in a manufacturing cycle. Therefore, each of the die member 64 and 66 may be supported in association with a slidable plate 68 and 70 which is supported in sliding engagement with support blocks 72 and 74 in a channel or slot 76. The support block 74 may be adjusted relative to the plates 68 and 70 for smooth slidable operation of the plates within slot 76 by means of an adjustment mechanism 78. Each of the plates 68 and 70 may be moveable toward and away from the nest 60 or 62 by means of a hydraulic ram 77 or other suitable mechanism. Within the nest 60 or 62, a cutting and forming system 80 is provided in the recessed portion of the nest 60 or 62. Between the die members 64 and 66 and the cutting and forming system 80, a circular channel 82 is formed by the recess of the nest 60 or 62, the channel 82 being dimensioned to accept the work piece as shown in FIG. 1, with the work piece extending into the channel 82 to a predetermined depth. Associated with the nest 60 or 62 is a base plate at the bottom of channel 82 on which the work piece is supported within the nest 60 or 62 at the predetermined position. As will be hereinafter described in more detail, the base plate is formed in association with a moveable platen 84 which is operated on by a pair of hydraulic rams 86 or other suitable mechanism. Providing hydraulic rams 86 or other suitable mechanism on opposed sides of the moveable platen 84 ensures proper operation to selectively move platen 84 upwardly or downwardly with respect to the housing and other components of the apparatus 50. The moveable platen 84 preferably carries at its upper end the base plate 88, with a drive plate 90 at the bottom end thereof The central portion 92 of platen 84 is a cylindrical portion extending between plates 88 and 90. The plates 88 and 90 each have apertures coinciding with the cylindrical portion 92 to define a hollow interior through which a drive shaft arrangement 94 is positioned. The drive shaft system 94 is coupled to be driven by a hydraulic motor 96 supported in association with housing 52. The platen assembly 84 is moveable about the drive shaft assembly 94 upwardly and downwardly to selectively position a work piece relative to the die members 64 and 66 and the cutting and forming system 80. The platen assembly 84 may further include a guide mechanism 98, which will prevent rotation of the platen assembly 84 by any lateral forces which may be imposed thereon. The guide mechanism 98 may simply comprise a guide pin positioned within a track or channel member 100 supported in association with housing 52. Other suitable mechanisms may also be utilized, or no guide mechanism may be necessary.

The cutting and forming system 80 associated with each of the nests 60 or 62 is preferably designed to simultaneously cut, pre-form and finish form the coupling beads which reconnect and lock together cut portions or gores of the work piece as previously described. In general, once the work piece is positioned in nest 60 or 62, operation of the cutting and forming system 80 will initially cut the work piece along a predetermined angular position defined by the angle of the upper surface 54 relative to the work piece positioned within nest 60 or 62. In desired operation, the cut performed by the cutting and forming system 80 is oriented at 15° relative to the outlet opening of the work piece as previously described, and at a predetermined position or distance from the outlet opening 20. Once the work piece is cut by the cutting and forming system 80, the coupling bead must then be formed in the respective gores of the work piece adjacent the cut line and the gores interconnected via the formed coupling bead. To accomplish this, in the preferred operation and with reference to FIG. 4 showing the finished duct member 10, the work piece is positioned in nest 60 in a first stage of operation, to form the cut and coupled bead connection 26 between gores 14 and 16 in duct member 10. In the preferred operation, the cutting and forming system 80 will simultaneously pre-form the bottom edge of gore 14 and the top edge of gore 16 with a slight inward taper so that gore 16 can be moved into overlapping relationship with gore 14. The beads formed in the gores 14 and 16 may also be pre-formed for thereafter forming the coupled bead 26 which interconnects these gores so that they cannot be separated, but allows relative rotation therebetween. Once the gores 14 and 16 are overlapped, the beads in each are finally formed in conjunction with one another to form coupled bead 26, by means of the cutting and forming system 80 so as to cooperate with one another in this fashion. Preferably, the material from which the work piece is formed is of significant structural integrity whereby the beads formed in each of the gores 14 and 16 are relatively deep and consistently formed to facilitate maintaining the connection between these gores while ensuring smooth and easy relative rotation between the gores.

Subsequent to formation of the coupling bead 26, the work piece is then removed from nest 60 and positioned in nest 62 to form the second cut and coupled bead 24 between gores 12 and 14. The work piece is rotated 180° before being positioned in nest 62 to form the opposing 15° moveable seam 24. If a single work station is used to perform both operations, a mechanism to rotate the work piece may be provided. In the described embodiment, the work piece is positioned within the recess formed by nest 62 to a deeper extent so as to position the coupled bead 24 at a predetermined position relative to the other gores of duct member 10. A similar operation is then performed by the cutting and forming assembly 80, whereby the work piece is cut forming gores 12 and 14, the edges of the gores 12 and 14 are pre-formed so as to ease positioning in slightly overlapping relationship and the cooperating beads may be pre-formed in each of the gores. Once the gores are repositioned in overlapping relationship, the beads are finally formed in conjunction with one another to reconnect the gores in locked relationship while allowing relative rotation therebetween. As should be recognized, because the work piece from which the duct member is made is preferably formed as a tapered tube, the size of the nest 62, die member 64 and 66 and cutting and forming assembly 80 are differently sized from those components in nest 60 to accommodate the greater diameter at the location of coupled bead 24. In this way, the apparatus 50 can be configured to accommodate any size tube, and these components can also be interchangeable for varying the size of duct member produced thereby. Additionally, it may be desirable to have a longer throat portion or gore 12 associated with the duct member 10, and again the nests 60 and 62 as well as associated die members and cutting and forming systems 80 would all be designed to accommodate such a configuration.

Also in the preferred embodiment, as cutting and forming operations are performed by the assembly 80, there may be a lubricating system generally designated 102 which will selectively apply lubrication to the interior of the work piece at the location of the cutting or forming operations as desired. Any suitable lubrication system may be used in this regard. In addition, the apparatus 50 preferably includes a control system generally designated 110, which may be any suitable system such as a microprocessor or PLC based system, to selectively perform the various operations and steps to produce the duct member 10 according to the methods of the invention. Preferably, control system 110 can be designed to automatically perform various operations in a manufacturing sequence to produce a particular type of duct member 10. Each different type of duct member will effectively have a process sequence recipe that can be simply recalled using the control system 110, with subsequent automated performance of each step in the manufacture of the duct member 10. In this way, an unskilled operator can simply recall a particular recipe for the type of duct member to be produced, alleviating the necessity for a skilled operator and simplifying the manufacturing process. The functions controlled by the control system 110 will be described in more detail with reference to a preferred hydraulic circuit which controls various functions in the apparatus 50.

Figure 9:
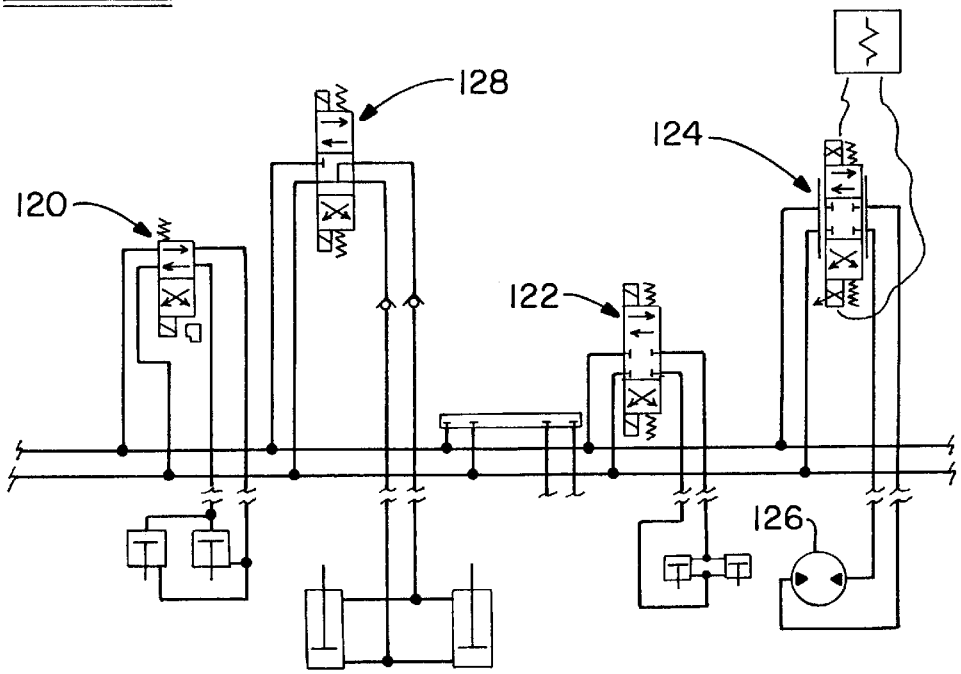
FIG. 9 is a schematic diagram of the control system associated with each nest in the apparatus of the invention.

Turning to FIG. 9, the various control functions of the preferred embodiment are shown schematically for one of the nests 60 or 62 and the associated functions performed when the work piece is inserted therein. It should be understood that the control functions as described in FIG. 9 are similar for each of the nests 60 or 62 and the associated components, and therefore only one of the hydraulic control systems is shown for clarity. In FIG. 9, a hydraulic control circuit is shown, although other types of controls are contemplated in the invention, and the invention is not limited to the control of various functions by hydraulic mechanisms. Corresponding to the operation of the apparatus 50 as previously described, and in the preferred embodiment, the work piece once positioned in a nest 60 or 62 is preferably clamped in position to ensure proper positioning with respect to the cutting and forming assembly. Within the recess or channel 82 of nest 60 or 62, a work piece retaining mechanism is provided, the preferred embodiment to be described hereafter. In general, the work piece retaining mechanism may be a tube clamp which is engaged with the bottom of the work piece positioned within recess 82, but any suitable clamping mechanism may be utilized. Operation of the clamp may be controlled hydraulically by means of a hydraulic circuit including valve 120 operated by the control system 110 previously described. Once the work piece is properly positioned and clamped, the cutting and forming operation may begin, wherein it may be desirable to initially lube the surfaces of the work piece prior to cutting and forming. A lube mechanism controlled by a hydraulic circuit and associated valve 122. The cutting and forming operation performed by the cutting and forming assembly 80 is then initiated by means of a hydraulic circuit component 124, and preferably includes a proportional valve used to control the hydraulic motor 126 to extend the life of the hydraulic motor by avoiding excessive wear caused by repeatedly starting and stopping the motor during a manufacturing cycle or in distinct cycles. In association with the cutting and forming operation, the control system 110 further controls a hydraulic circuit and associated valve 128 to operate the hydraulic cylinders engaging the platen assembly on which the work piece is supported. The position of the work piece relative to the cutting and forming assembly is thus varied to form the cooperative bead coupling as previously described by up and down movement of the platen assembly. Other control functions may also be performed by the control system as desired.

Figure 10:
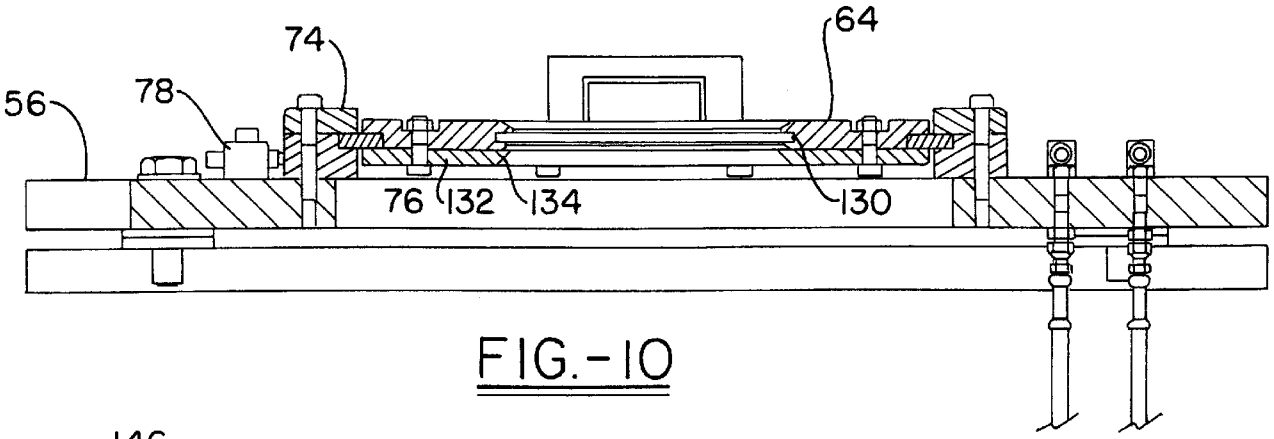
FIG. 10 shows an enlarged partial sectional view of the upper plate and die assembly.

Turning now to FIG. 10, the top plate assembly and associated die members and cutting and forming head are shown in more detail. The die members 64 and 66 as previously described are designed to cooperate with one another to form when positioned adjacent the work piece a stationary form into which material of the work piece is pushed y the cutting and forming system 80. Preferably the die members 64 and 66 are formed to include a recess, which will cooperate with a portion of the forming system 80 to generate an outwardly directed bead in the work piece of substantial depth. Below the forming section of the die, a separate plate 132 may be provided with an outwardly extending knife edge 134 which is designed in cooperation with the cutting and forming assembly to cut the work piece at the desired position. Providing the knife as a separate member 132 facilitates maintenance of the apparatus, as it is possible for the knife or knife edge to become damaged, simplifying replacement of the plate 132 without impact on the forming section of the die formed by die member 64 and 66. The particular shape of the forming portion or knife portion of the die may be modified to produce a desired coupling bead configuration other than that shown in the preferred embodiment.

Figure 12:
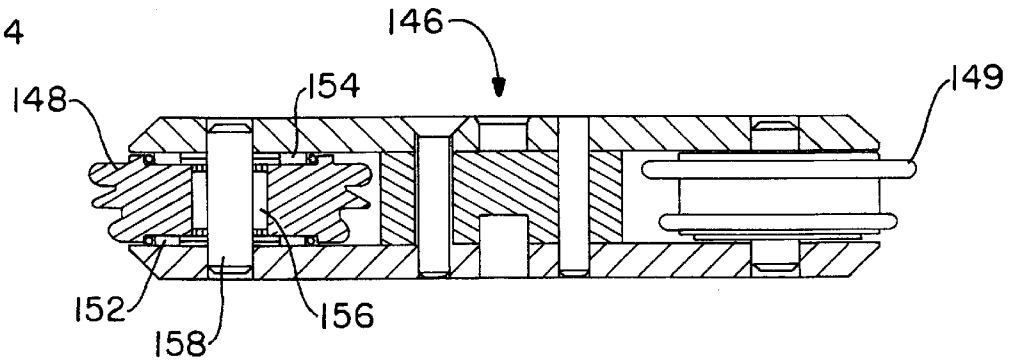
FIG. 12 shows a partial sectional view of the roller assembly associated with the assembly shown in FIG. 11.
Figure 11:
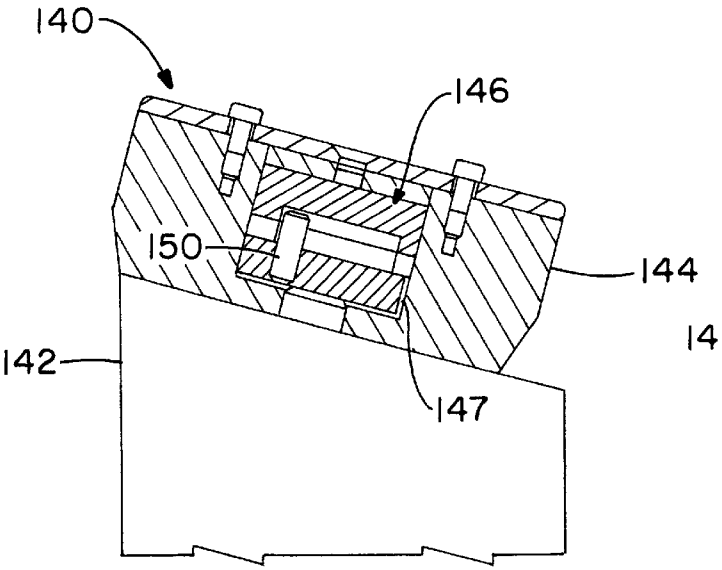
FIG. 11 shows a partial sectional view of the cutting and forming assembly.

FIGS. 11 and 12 refer to a preferred embodiment of the cutting and forming assembly 80 of the invention, although other mechanisms to perform the functions of assembly 80 would occur to those skilled in the art. In FIG. 11, the cutting and forming assembly may comprise a head portion 140 including a supporting block 142 carrying a rotating working head 144 shown in section. The drive shaft 94 driven by motor 96 is positioned to extend through the support block 142 and is coupled to the working head 144 for selective rotation thereof. The working head 144 includes a moveable slide block 146 mounted within a slot 147, having a cutting wheel 148 at one end thereof and a beading wheel 149 on the other end. The slide block 146 is moved back and forth to provide cutting and beading steps successively, with each of the wheels 148 and 149 being successively exposed to perform these operations as the head 144 rotates. The back and forth motion of the slide block 146 within slot 147 is created by an eccentric drive shaft mounted in the center of the working head 144. This shaft is driven through an appropriate gear assembly to couple rotation of the drive shaft 94 to the eccentric drive shaft. An off-center pin 150 associated with the eccentric shaft is engaged in a slot in the bottom of the slide block 146 which moves the slide block 146 within slot 147 so as to selectively expose one of the wheels 148 or 149 as the head 144 rotates. The slide block 144 is initially centered within slot 147, and the cutting wheel 148 is then moved out into engagement with the interior of the work piece, and cooperates with the knife edge on the stationary die member as previously described to cut the work piece. The slide block 144 then moves to expose the beading wheel 149 after the cut pieces of the tube are positioned in overlapping relationship. In cooperation with the stationary die member, the bead coupling is formed. The operation of the head 144 may be similar to that provided in a machine produced by Iowa Precision Industries referred to as an AEM Gearhead Machine. Also in the preferred embodiment, the wheels 148 and 149 are mounted in the slide block 144 with bearing assemblies 152 and 154 above and below the wheels and bearings 156 about a center post 158 to ensure proper alignment and operation of the wheels. Using this construction in association with the stationary die member provides very high precision in the cutting and forming of the coupling beads for smooth rotation between the gores of the duct member.

While the above description has been presented with specific relation to a particular embodiment of the invention and methods of producing a tapered and adjustable duct member, it is to be understood that the claimed invention is not to be limited thereby. It will thus be seen that the objects set forth above, among those made apparent from the preceding description, are obtained. Certain changes may be made without departing from the scope of the invention and the above description is intended to be interpreted as illustrative and not limiting.

What is claimed is:

1. An apparatus for forming an adjustable tapered top take off duct member for use in an air handling system comprising, a housing including at least two work stations formed therein, each workstation adapted to accommodate a tapered work piece, a first die associated with said first work station which is selectively positioned at a predetermined location relative to said tapered work piece positioned in said first work station, a second die associated with said second work station which is selectively positioned at a predetermined location relative to said tapered work piece positioned in said second work station, wherein said first and second dies are different sizes adapted to accommodate different sized sections of said tapered work piece, a first cutting and forming assembly associated with said first work station which cooperates with said first die to selectively cut said tapered work piece to form first and second tapered members and to form a coupling bead in said first and second tapered members which cooperate to reconnect said first and second tapered members together at a predetermined angle, a second cutting and forming assembly associated with said second work station which cooperates with said second die to selectively cut said tapered work piece to form first and second tapered members and to form a coupling bead in said first and second tapered members which cooperate to reconnect said first and second tapered members together at a predetermined angle, wherein each of said work stations include a positioning system to position said tapered work piece at a predetermined position for cutting and forming said coupling beads, wherein each work station includes an insertion channel having predetermined dimensions to provide sufficient clearance to accommodate the tapering diameter of said tapered work piece, and a control system for at least selective control of said first and second cutting and forming assemblies.

2. The device of claim 1, wherein said first and second cutting and forming assemblies are configured to have a range of motion to interact with said first and second dies having different sizes to accommodate different elliptical sections of said tapered work piece.

3. The device of claim 1, wherein said work piece has an outlet opening, wherein said first and second members are reconnected at an angle of substantially 15 degrees relative to one another.

4. The device of claim 1, wherein each work station further comprises a moveable platen supporting an upper surface.

5. The device of claim 1, wherein each work station further comprises at least one actuator associated with said platen to selectively move said platen upwardly or downwardly with respect to said housing.

6. The device of claim 1, wherein each work station further comprises a lubricating mechanism which will selectively apply lubrication to lubricate surfaces of said tapered work piece during cutting or forming.

7. The device of claim 1, wherein each die is formed to include at least one recess forming a bead in at least one of said first or second members in conjunction with each corresponding one cutting and forming assembly.

8. The device of claim 1, wherein each work station further comprises a clamping mechanism which selectively engages and positions said tapered work piece during cutting or forming.

9. The device of claim 1, wherein each clamping mechanism is controlled hydraulically by means of a hydraulic circuit.

10. The device of claim 1, wherein said control system includes a hydraulic circuit having a proportional valve used to control a hydraulic motor.

11. The device of claim 1, wherein each cutting and forming assembly simultaneously cuts said tapered work piece at a predetermined location and angle while preforming said cutting beads on each of said first and second members and at least one of said first or second members then selectively moved such that said pre-formed coupling beads are overlapped, and thereafter each said cutting and forming assembly finishes formation of said coupling beads with said first and second members coupled to one another.

12. The device of claim 1, wherein said control system automatically controls operation of each work station including operation of each of said dies and each of said cutting and forming assemblies to selectively clamp said tapered work piece in a predetermined position within each work station, operating each die in conjunction with each respective cutting and forming assembly to selectively cut said tapered work piece, form said coupling beads and reconnect said first and second members together at said predetermined angle.

13. The device of claim 1, wherein each cutting and forming assembly includes a rotating working bead supporting at least one cutting wheel and at least one beading wheel which are selectively exposed to work on said tapered work piece.

14. The device of claim 1, wherein each cutting and forming assembly includes at least one beading wheel having at least one outwardly extending portion which cooperates with each corresponding die to selectively form said coupling bead.

15. The device of claim 14, wherein said at least one beading wheel is formed as a one-piece member.

16. The device of claim 14, wherein at least two outwardly extending portions are formed on said beading wheel which cooperate with each die to at least partially form said coupling bead in each of said first and second members.

17. The device of claim 13, wherein said at least cutting and beading wheel are mounted on bearing assemblies.

* * * * *